United States Patent [19]

Russell

[11] Patent Number: 4,941,617

[45] Date of Patent: Jul. 17, 1990

[54] AIRBLAST FUEL NOZZLE

[75] Inventor: Sid Russell, Suffield, Conn.

[73] Assignee: United Technologies Corporation, Hartford, Conn.

[21] Appl. No.: 284,270

[22] Filed: Dec. 14, 1988

[51] Int. Cl.[5] ..... B05B 7/04; B05B 7/10

[52] U.S. Cl. ..... 239/400; 239/406

[58] Field of Search ..... 239/400, 402, 403, 404, 239/405, 406

[56] References Cited

U.S. PATENT DOCUMENTS

| | | | |
|---|---|---|---|
| 3,383,049 | 5/1968 | Guerin | 239/400 |
| 3,474,970 | 10/1969 | Simmons et al. | 239/404 |
| 3,980,233 | 9/1976 | Simmons et al. | 239/400 |
| 4,105,163 | 8/1978 | Davis, Jr. et al. | 239/406 |
| 4,324,361 | 4/1982 | Moos et al. | 239/3 |
| 4,544,100 | 10/1985 | Simashkevich et al. | 239/415 |
| 4,558,822 | 12/1985 | Nieuwkamp et al. | 239/403 |
| 4,616,784 | 10/1986 | Simmons et al. | 239/404 |

FOREIGN PATENT DOCUMENTS

| | | | |
|---|---|---|---|
| 843641 | 8/1960 | United Kingdom | 75/1 |
| 2172099 | 9/1986 | United Kingdom | 239/400 |

OTHER PUBLICATIONS

AIAA-87-2135, "Influences on Fuel Spray Circumferential Uniformity" by T. J. Fosfjord and S. Russell.

*Primary Examiner*—Andres Kashnikow
*Assistant Examiner*—Karen B. Merritt

[57] ABSTRACT

An airblast type fuel nozzle of the type utilized in gas turbine engines is disclosed. Various concepts capable of enhancing the atomization of over a wide range of fuel flow rates are discussed. In one particular embodiment a recirculating air flow pattern at low fuel flow rates is established within a swirl chamber prior to the discharge of the fuel into the core airstream.

7 Claims, 2 Drawing Sheets

FIG. 1
PRIOR ART
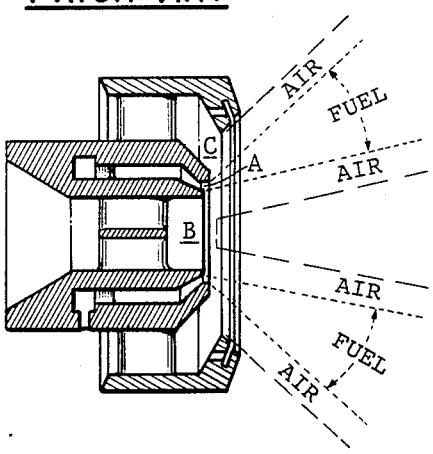
FIG.3A
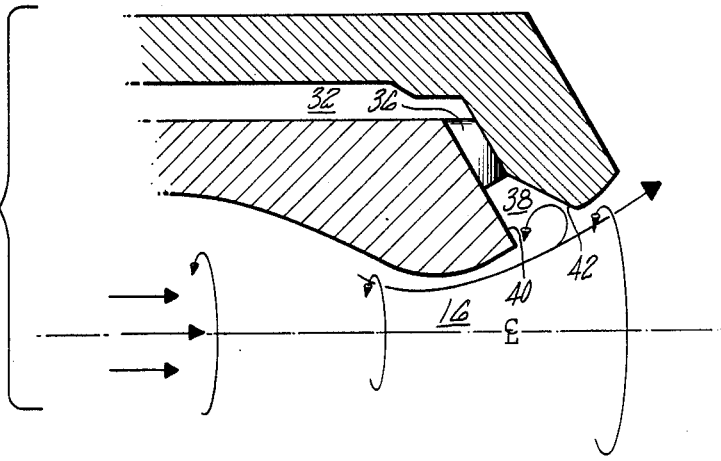
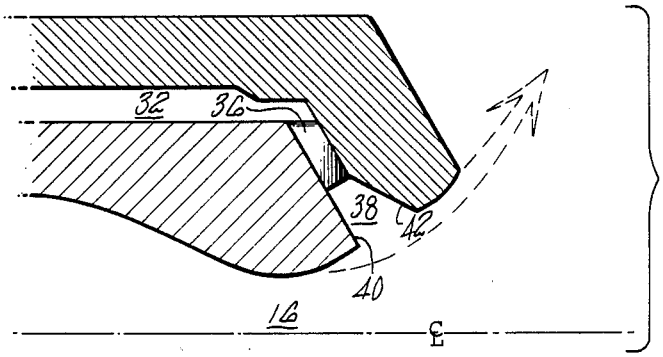
FIG. 3B

AIRBLAST FUEL NOZZLE

TECHNICAL FIELD

This invention relates to airblast fuel nozzles of gas turbine engines, and more specifically to nozzles capable of efficient operation over a wide range of power levels and fuel flow rates.

BACKGROUND ART

Performance requirements for fuel nozzles of gas turbine engines have become increasingly demanding over the past several years. New higher efficiency engines are being operated over a wider range of operating conditions and historical aircraft operating patterns are being markedly changed in the interest of conserving fuel. Fuel flow rates may vary from less than ten (10) pounds per hour to more that eight hundred (800) pounds per hour. At the same time emissions requirements are becoming more stringent. The length of time between engine hot section overhauls is increasing and, in certain applications, there is an increasing interest in the use of lower grade fuels.

Nozzles typical of the prior art applicable to the present invention can be grouped into two general classes, "duplex nozzles" and "pure airblast nozzles". Duplex nozzles comprise a pressure atomizing component for low fuel flow operation and an airblast atomizing component for operation at high fuel flow rates. Two separate and synchronized fuel control systems are required.

Pure airblast nozzles utilize airblast over the full range of engine operation. Such a nozzle typical of those used in advanced commercial gas turbine engines is shown in FIG. 1 (Prior Art). Fuel is injected through a pressure atomizing nozzle "A"; pressurized air is sprayed into the combustion chamber at the core "B" of the nozzle and at the outer periphery of the fuel flow "C" of the nozzle. An American Institute of Aeronautics and Astronautics paper entitled "Influences on Fuel Spray Circumferential Uniformity" by T.J. Rosjford and S. Russell, AIAA-87-2135 dated June 29, 1987, presents a sensitivity analysis and discusses detailed design features of advanced airblast nozzles.

Modern airblast nozzles use a delicate balance of air and fuel flow momenta to achieve high levels of atomization. As a consequence, these nozzles are particularly susceptible to perturbations which can result in undesirable fuel patterns. Such nozzles of the past have generally performed poorly at low fuel flow conditions, and at times have shown poor circumferential uniformity at high fuel flow rates. Scientists and engineers are in search of new advances capable of improved operation at one or both of these conditions.

DISCLOSURE OF INVENTION

An object of the present invention is to provide a gas turbine engine fuel nozzle capable of efficient operation over a wide range of fuel flow rates. Specific objects are to rapidly and thoroughly atomize fuel flowing to the burner of such an engine prior to the onset of combustion.

According to the present invention fuel dischargeable into the core air stream of an airblast fuel nozzle is evenly distributed at both high and low fuel flow rates about an annular swirl chamber circumscribing and opening to the core air stream.

In accordance with one detailed embodiment of the invention and swirl chamber is of sufficient volume and orientation such that a swirling toroid of fuel and air is formed within the chamber at low fuel flow rates, resultantly dragging fuel circumferentially about the chamber to achieve a uniform distribution prior to discharge into the core air stream.

In further accordance with detailed embodiments of the invention the swirl chamber has an upstream wall essentially perpendicular to the direction of flow of the core air past the swirl chamber to aid in the formation of the swirling toroid of fuel and air at low fuel flow rates, and a downstream wall having a fuel forming lip over which fuel at high fuel flow rates is caused to flatten into a circumferentially uniform sheet prior to discharge into the core air stream.

Primary features of the present invention are the venturi at the core of the fuel nozzle and the swirl chamber disposed radially outwardly of the venturi. Other features in detailed embodiments include radially oriented swirl vanes at the fuel inlet to the swirl chamber, the wall at the upstream end of the chamber, and the fuel forming lip at the downstream end of the chamber.

Fuel is swirled radially inwardly by the swirl vanes into the chamber. At low fuel flow rates, core air flowing over the upstream wall forms a swirling toroid in which fuel and core air is mixed. The fuel/air mixture is thence drawn across the fuel forming lip at the downstream end of the swirl chamber by air flowing through the venturi at the core of the fuel nozzle and is discharged therewith into the burner of the gas turbine engine. At high fuel flow rates fuel swirls freely within the chamber to form a uniform sheet of fuel emanating therefrom over the downstream wall.

The foregoing and other features and advantages of the present invention will become more apparent from the following description and drawings.

BRIEF DESCRIPTION OF DRAWINGS

FIG. 1 (Prior Art) is a schematic illustration of an airblast fuel nozzle of the type heretofore utilized in gas turbine engines;

FIG. 3A is an enlarged view of the fuel nozzle swirl chamber shown in the fuel nozzle of FIG. 2 operating at a low fuel flow rate; and FIG. 3B is an enlarged view of the fuel nozzle swirl chamber shown in the fuel nozzle of FIG. 2 operating at a high fuel flow rate.

BEST MODE FOR CARRYING OUT THE INVENTION

Figure 2:
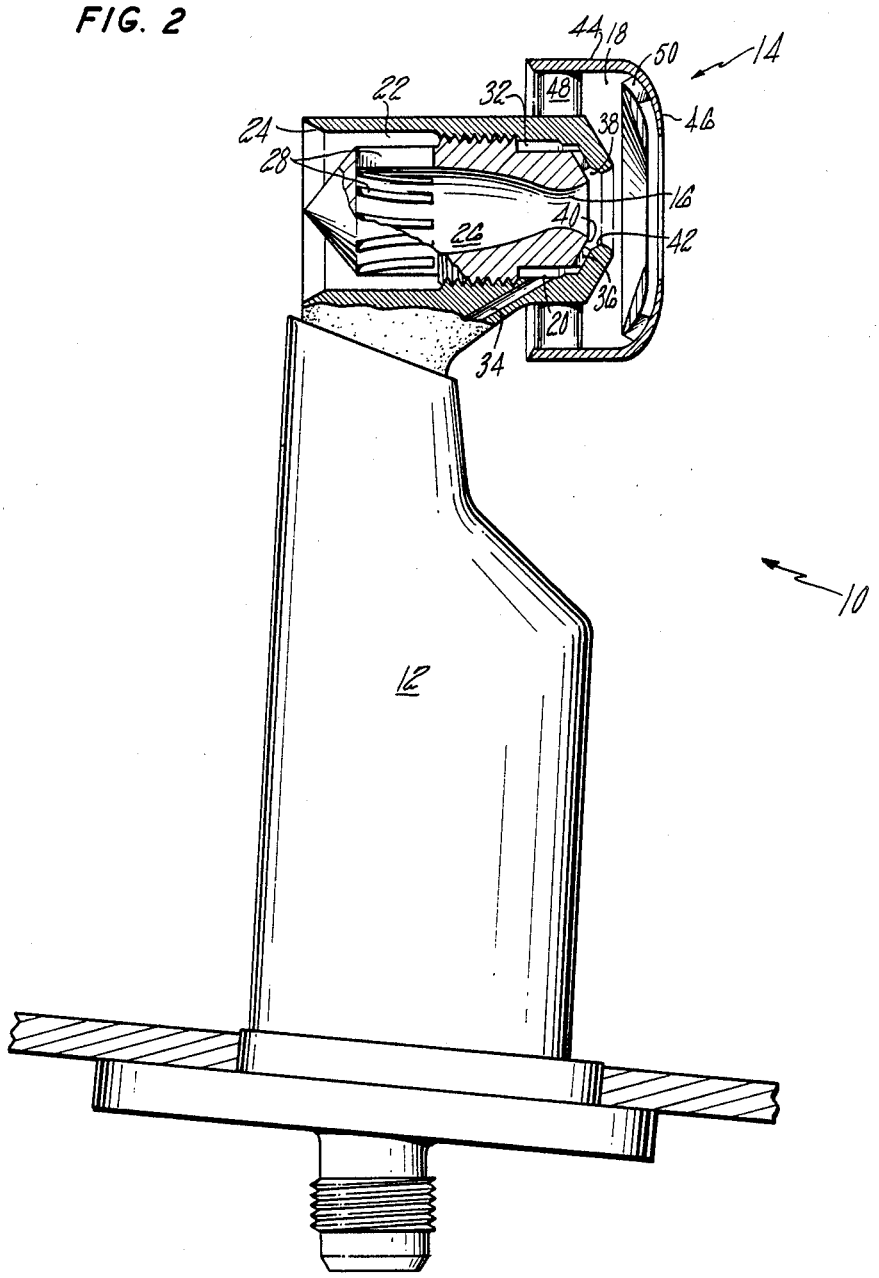
FIG. 2 is a simplified cross section illustration of an airblast fuel nozzle incorporating the present invention.

A simplified cross-sectional view of the gas turbine engine fuel nozzle 10 of the present invention is shown in FIG. 2. The nozzle is of the type disposed at the upstream of the combustion chamber (not shown) of a gas turbine engine. The nozzle illustrated is commonly referred to as an airblast nozzle or airblast injector. A fuel nozzle body 12 supports the operative end 14 of the of the nozzle. Most noticeable features of the operative end are the core air passage 16, the outer air passage 18, and the fuel passage 20.

An upstream portion 22 of the core air passage 16 is formed between the downstream end of the fuel nozzle body 12 and a core air scoop 24. A downstream portion 26 of the core passage is formed at the center of the downstream end of the fuel nozzle body and is formed to a venturi shaped contour. Core air swirl means 28 is disposed across the downstream end of the fuel nozzle body between the upstream portion of the core air passage and the downstream portion of the core air passage. A plurality of inwardly directing vanes form the swirl means illustrated in FIG. 2. A plurality of slots, holes, or other equivalent structure may be employed in alternate embodiments.

An upstream portion of the fuel passage 20 is formed between the downstream end of the core air scoop 24 structure and the downstream end of the fuel nozzle body 12. In particular, an annulus 32 is formed. Fuel is flowable to the annulus through one or more fuel feed tubes 34. From the annulus the fuel passage extends inwardly across a plurality of fuel swirl means 36 which may be in the form of radially oriented vanes or slots machined into the downstream end of the fuel nozzle body or into the core air scoop structure.

Downstream of the fuel swirl means is a swirl chamber 38. The chamber is bounded by an upstream wall 40 and a downstream wall 42, the function of which is discussed later in detail within this specification. The downstream wall diverges from the upstream wall in a rounded contour to form the swirl chamber therebetween.

An outer air scoop 44 is disposed about the core air scoop 24 to form the outer air passage 18. The downstream end 46 of the outer air scoop extends radially inwardly toward the centerline of the fuel nozzle to give the outer air passage a correspondingly inwardly directed contour. Outer air swirl means, such as the vanes 48 are disposed across the outer air passage between the outer and core scoops. In the embodiment shown, additional swirl means 50 are disposed along the radially inwardly extending portion of the outer air passage at the outer air scoop.

During operation of a gas turbine engine in which the described fuel nozzle is installed, fuel is flowed through the feed tube 34 and into the annulus 32. Fuel exits the annulus across the swirl means 36 and into the swirl chamber 38. The discharged fuel has both a circumferential and a radially inward velocity component such that the fuel is apportioned evenly about the swirl space. The radially oriented fuel swirl means is more efficient in causing uniform flow than more conventionally utilized axial swirlers. Discharging the fuel with a circumferential velocity, component and an inward velocity component results in apportionment of the fuel about the chamber and reduces the tendency of fuel to puddle to one side of the nozzle at low fuel flow rates.

The core air channel is contoured to a venturi configuration. Fuel is introduced into the core airstream through the swirl chamber 38 at a location along the venturi just downstream of the point of maximum constriction in order to take advantage of the aspirating capacity of the core air flow. This further aids in the distribution of fuel.

Referring to FIG. 3A, the volume of the swirl chamber 38 is relatively small in comparison to the volume of the combustion chamber to which fuel is conventionally discharged and may be referred to as a diminutive swirl space. This diminutive swirl space, swirl chamber, is preferably configured such that the upstream wall is normal to the core air flow through the venturi. As the swirling air flows past this upstream wall, a recirculating pattern is established within the space. The recirculating pattern is that of a swirling toroid of air and very effectively drags the fuel circumferentially with air in the space. Uniform distribution at even very low flow rates results.

The volume within the swirl space or chamber 38 is sized for each engine configuration to provide adequate volume at high fuel flow rates. The volume must be sufficiently large to enable the fuel to swirl freely and thereby flatten out against the downstream wall of the chamber as shown in FIG. 3B. Ideally, the fuel at high fuel flow rates is discharged in a uniform sheet. If the swirl chamber is too small and the space between the walls is too narrow to allow "free swirl", the individual jets of fuel from the swirl means are not diffused. In such a case the circumferential distribution will not be uniform. Providing free swirl collaterally reduces the sensitivity of the structure to manufacturing irregularities such as imperfections in concentricity of the multiple pieces and details contained in the fuel nozzle.

In the embodiment shown, core air at the swirl means 28 is introduced through a radial inflow swirler. The inflow swirler avoids "spoked" flow frequently associated with axial swirlers and the resultant non-uniformities in spray cone distribution. The rounded region of the downstream wall forms the fuel into a uniform sheet at discharge. The contour of the core air passage including the fuel filming lip establishes the discharge angle of the core airflow.

The discharge angle of the core airflow and the angle of the fuel forming lip at discharge relative to the center line (C/L) of the fuel nozzel are substantially the same. Angles on the order of forty-five (45) to fifty (50) degrees are common to most embodiments of the present invention.

As with conventional air channels, changes in discharge profile are possible by altering the swirler strength and geometry of the channel. A capability for greater control of core air discharge profile is important to improving engine light-off, lean blow-out, and smoke formation characteristics for each engine application. All can be achieved with the design flexibility afforded by the uniform fuel atomization and distribution of the present invention.

Although the invention has been shown and described with respect to detailed embodiments thereof, it will be understood by those skilled in the art that various changes in form and detail thereof may be made without departing from the spirit and scope of the invention.

I claim:

1. A gas turbine fuel nozzle of the type in which fuel is injection into a core stream of atomizing air, wherein the improvement comprises:

means for injecting fuel radially inwardly into the core air stream, including a swirl chamber radially outwardly of the core stream and opening into the core stream and swirl means upstream of the swirl chamber across which fuel is flowable into the swirl chamber wherein the swirl chamber is of sufficient volume and orientation as to cause the formation of a swirling toroid of fuel and air within the chamber at low fuel flow rates.

2. The invention according to claim 1 wherein the swirl chamber has an upstream wall oriented essentially perpendicularly to the direction of flow of atomizing air in the core stream and a downstream wall, and wherein the swirl means is positioned in close proximity to the chamber such that the swirl means causes the fuel to the apportioned about the chamber during operation.

3. The invention according to claim 1 wherein the swirl means is capable of causing fuel discharged thereacross to be apportioned over the downstream wall at high fuel flow rates such that fuel is discharged in a uniform sheet from said downstream wall.

4. The invention according to claim 1 wherein the improvement further comprises a wall radially bounding the core stream and wherein the wall is contoured to a venturi configuration capable of producing a low pressure region within the swirl chamber as the core stream is flowed therepast.

5. The invention according to claim 4 wherein the swirl chamber discharges to the core stream at a location along the venturi wall downstream of the point of maximum constriction of the venturi.

6. The invention according to claim 3 which further includes a fuel filming lip at the downstream wall of the swirl chamber which is coincident with the downstream end of the wall bounding the core stream.

7. The invention according to claim 6 wherein the angle of the downstream wall at the fuel filming lip relative to the centerline of the fuel nozzle is on the order of forty-five (45) degrees to fifty (50) degrees.

* * * * *